US005505614A

United States Patent [19]

Lin

[11] Patent Number: 5,505,614

[45] Date of Patent: Apr. 9, 1996

[54] HANDY GAS TORCH

[76] Inventor: Arlo H. T. Lin, No. 5, Lane 25, TaTung Rd., Wu Fong Hsiang, Taichung Hsien, Taiwan

[21] Appl. No.: 294,217

[22] Filed: Aug. 22, 1994

[51] Int. Cl.[6] ..... F23Q 2/28; F23Q 2/36

[52] U.S. Cl. ..... 431/143; 431/255; 431/344; 431/345; 431/266

[58] Field of Search ..... 431/255, 254, 431/344, 345, 266, 258, 264, 143

[56] References Cited

U.S. PATENT DOCUMENTS 4,952,138 8/1990 Ho ..... 431/255
4,954,078 9/1990 Nelson ..... 431/255
5,082,440 1/1992 Yamamoto ..... 431/255 X
5,123,837 6/1992 Farnham et al. ..... 431/255 X

*Primary Examiner*—Carl D. Price
*Attorney, Agent, or Firm*—Pro-Techtor International

[57] ABSTRACT

A handy gas torch including a gas lighter container, which holds a gas lighter, a top case covered on the gas lighter container, a top cover shell covered on the top case to hold down a flame nozzle and an push-button type ignition control knob at two opposite ends, an electronic ignition device received in a chamber inside the top case and controlled by the ignition control knob to catch fire in the flame nozzle, a slide switch moved in a vertical sliding way to press the gas lever of the gas lighter causing it to release fuel gas for burning.

4 Claims, 5 Drawing Sheets

HANDY GAS TORCH

BACKGROUND OF THE INVENTION

The present invention relates to a handy gas torch which comprises a horizontal push-button type ignition control knob for ignition control and a vertical slide switch for gas release control.

Various handy gas torches have been disclosed using commercially available gas lighters as a fuel source, and have appeared on the market. These handy gas torches have been intensively used for welding small items. U.S. Pat. No. 5,082,440 discloses handy gas torch, as shown in FIG. 1, which comprises an ignition device 10 at a back side, a flame nozzle 12 at a front side, a housing, which holds a gas lighter 14, a press button 11 for controlling the operation of the ignition device 10. When the press button 11 is depressed, the ignition device 10 is triggered to catch fire in the flame nozzle 12, and at the same time a linkage is operated to press the gas lever of the gas lighter 14 causing the gas lighter to release fuel gas to the flame nozzle 12 for burning. This structure of handy gas torch is not easy to operate because the press button 11 is disposed at the back side right above the ignition device 10. When the housing of the handy gas torch is held in the hand, it is difficult to press the thumb on the press button 11.

SUMMARY OF THE INVENTION

The present invention has been accomplished to provide a handy gas torch which eliminates the aforesaid drawback. To achieve this object, there is provided a handy gas torch comprised of a gas lighter container, which holds a gas lighter, a top case covered on the gas lighter container, a top cover shell covered on the top case to hold down a flame nozzle and an push-button type ignition control knob at two opposite ends, an electronic ignition device received in a chamber inside the top case and controlled by the ignition control knob to catch fire in the flame nozzle, a slide switch moved in a vertical sliding way to press the gas lever of the gas lighter causing it to release fuel gas for burning. Because the push-button type ignition control knob is horizontally disposed at the back, it can be conveniently pushed forwards to trigger the electronic ignition device.

DETAILED DESCRIPTION OF THE PREFERRED EMBODIMENT

Figure 1:
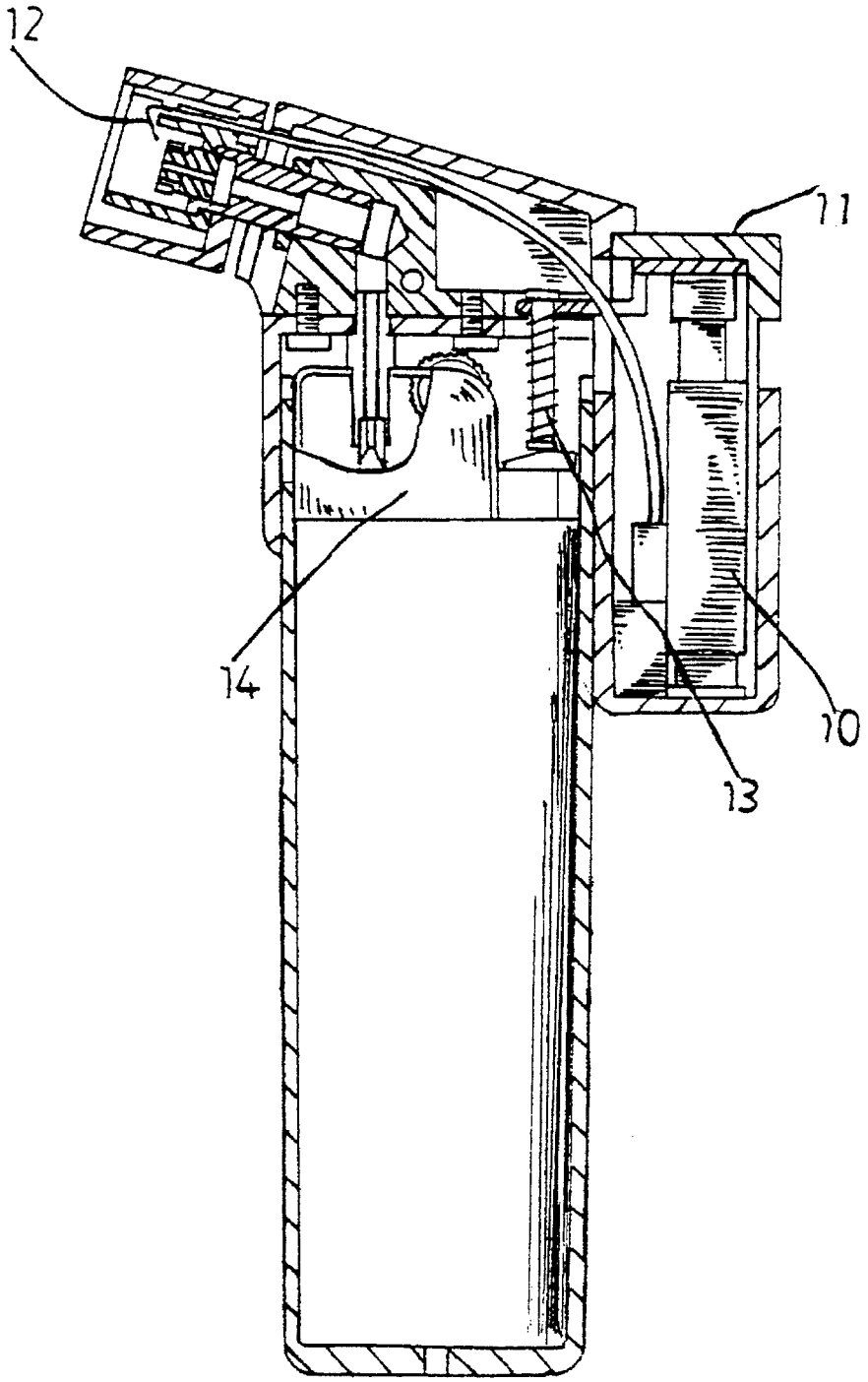
FIG. 1 ( PRIOR ART )
FIG. 1 is a longitudinal view in section of a prior art gas torch.
Figure 2:
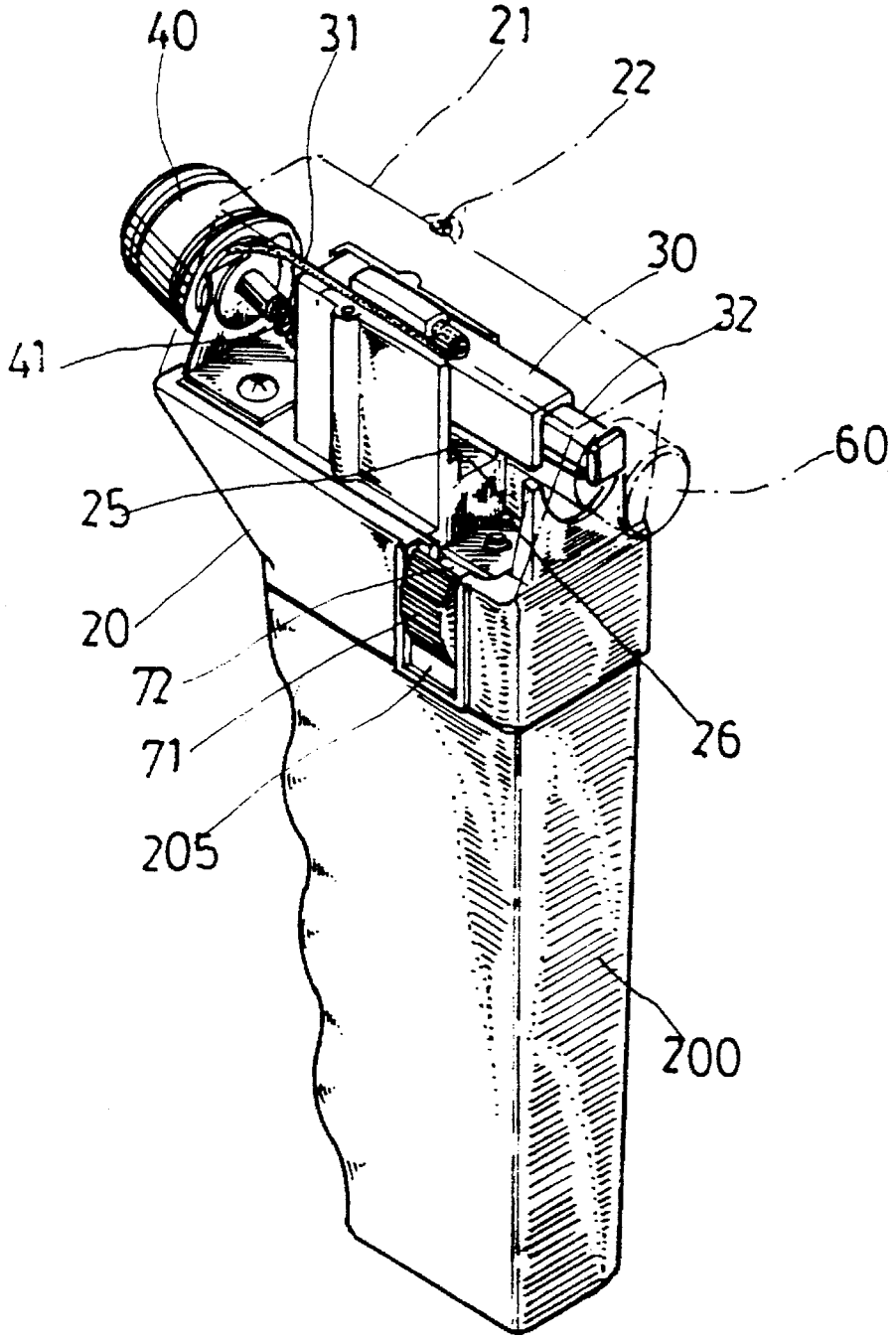
FIG. 2 is a perspective view of a handy gas torch according to the present invention.

Referring to FIG. 2, a handy gas torch in accordance with the present invention is generally comprised of a gas lighter container 200 and a top case 20 covered on the gas lighter container 200 at the top.

Figure 3:
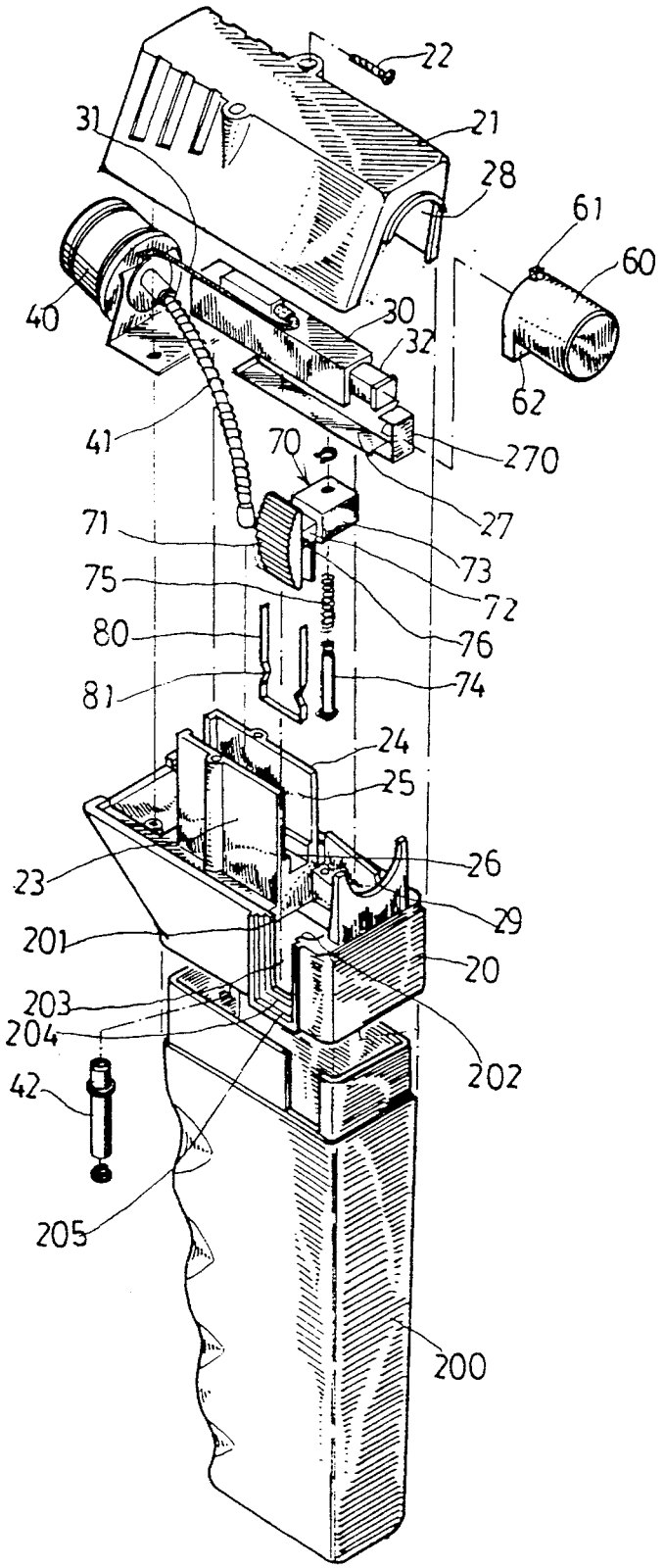
FIG. 3 is an exploded view of the handy gas torch shown in FIG. 2.
Figure 4:
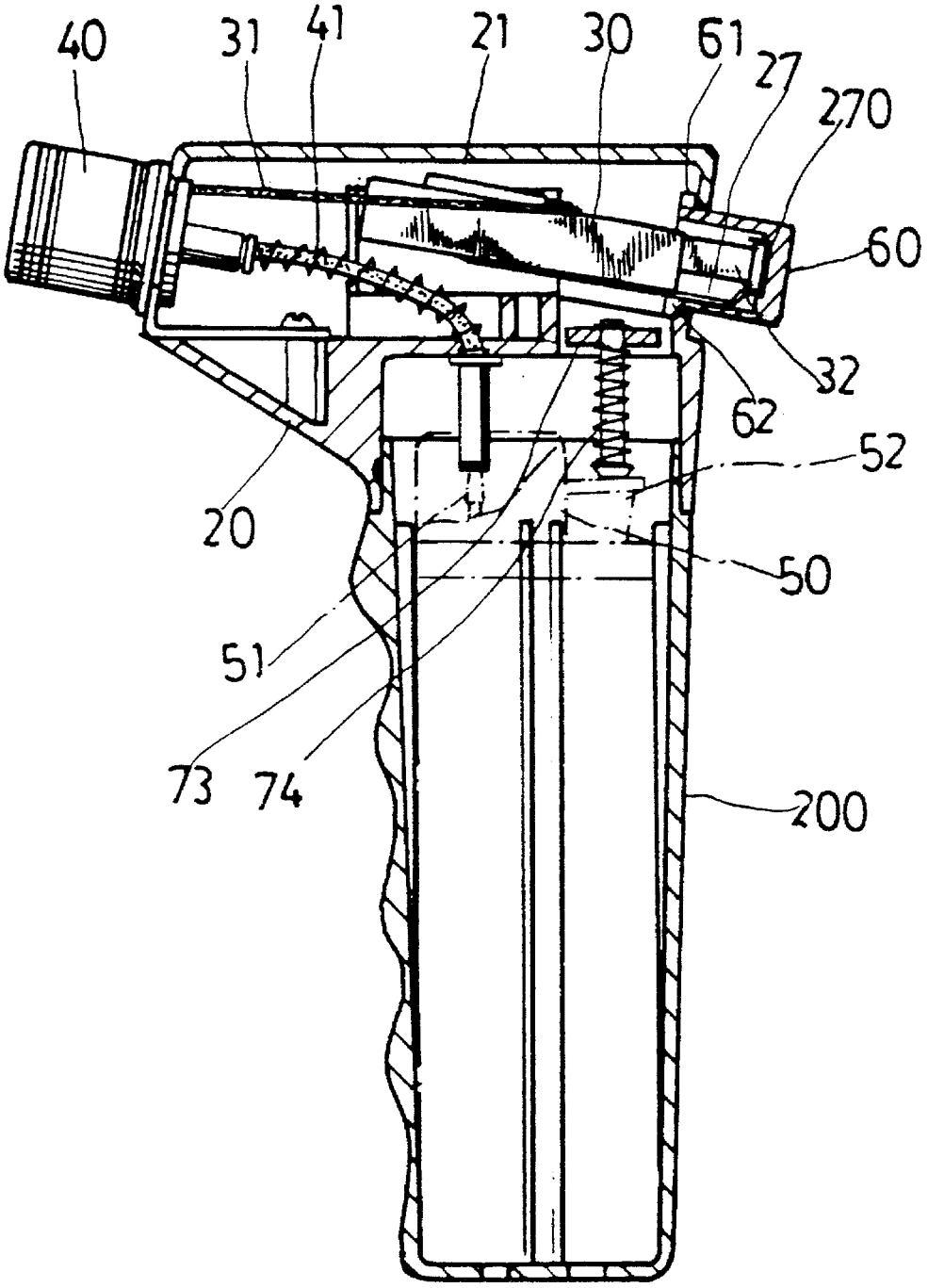
FIG. 4 is a longitudinal view in section of the handy gas torch shown in FIG. 2.

Referring to FIGS. 3 and 4, a top cover shell 21 which covers over the top case 20 is fastened to the top case 20 by a screw 22. The top case 20 is a top-open, substantially rectangular container having two upright partition boards 23 and 24, a horizontal chamber 25 defined between the upright partition boards 23 and 24, a retaining groove 26 inside the horizontal chamber 25 at the bottom. A locating plate spring 27 is received in the retaining groove 26. An electronic ignition device 30 is received in the horizontal chamber 25. The ignition conductor 31 of the electronic ignition device 30 is extended to the inside of a flame nozzle 40. The locating plate spring 27 has an curved tail 270 attached to the ignition push button 32 of the electronic ignition device 30 at the back. A gas tube 41 is provided having one end connected to the flame nozzle 40 and an opposite end coupled to a presser tube 42. The presser tube 42 is disposed in contact with the gas release control valve (not shown) on the gas lighter 50, which is received in the gas lighter container 200 (see also FIG. 4). Two half-round openings 28 and 29 are respectively made on the top case 20 and the top cover shell 21 at the back and coupled together into a round hole, which receives cylindrical control knob 60. The cylindrical control knob 60 is partially extended out of the top case 20 and the top cover shell 21, having a top flange 61 and a bottom flange 62 extended from the front end thereof in the reversed directions and constrained inside the top case 20 and the top cover shell 21 and stopped at the locating plate spring 27 and the ignition push button 32.

Referring to FIG. 3 again, the top case 20 further comprises two upright rails 201 and 202 at one side defining a vertical sliding way 203, a first step 204 and a second step 205. There is provided a slide switch 70 comprised of a knob 71 disposed outside the top case 20, a base block 73 disposed inside the top case 20, a neck 72 connected between the knob 71 and the base block 73 and moved vertically along the sliding way 203, a presser bar 74 coupled to the base block 73, and a compression spring 75 mounted around the presser bar 74 and stopped against the base block 73 at the bottom. A substantially U-shaped locating plate 80 is mounted within the first step 204 outside the sliding way 203, having two inward projections 81 disposed at two opposite sides. When the slide switch 70 is installed, the inside wall 76 of the knob 71 is vertically movably stopped at the second step 205.

Figure 5:
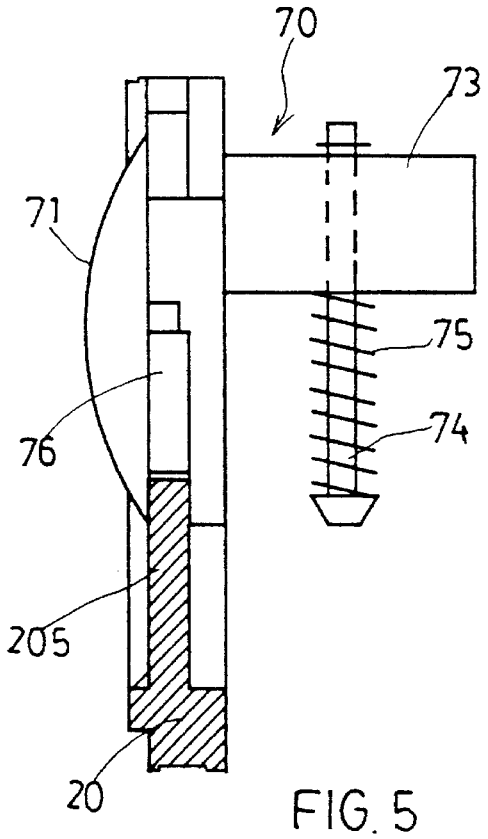
FIG. 5 is a side view in section taken on part of FIG. 4 around the area of the slide switch.
Figure 6:
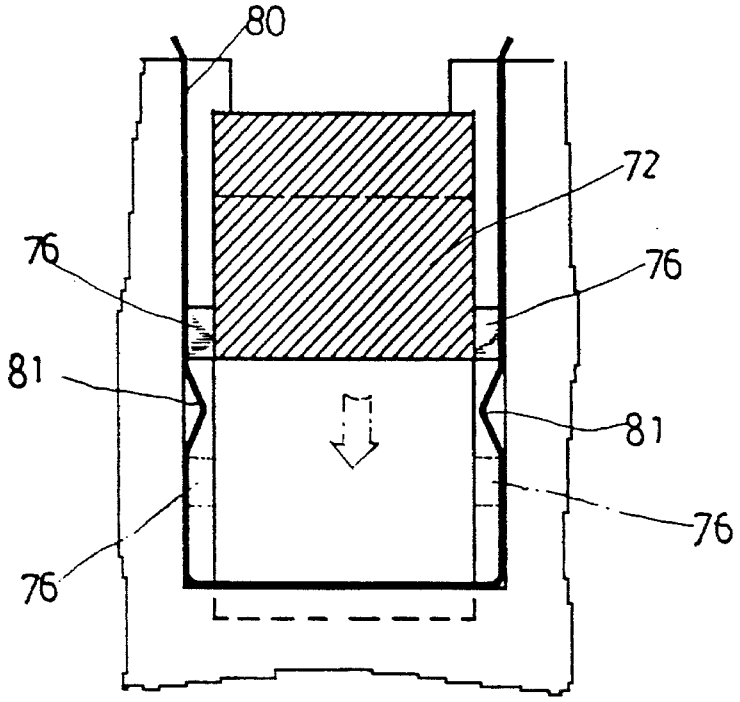
FIG. 6 is a cross section of FIG. 5.

Referring to FIGS. 5 and 6 and FIG. 4 again, when the slide switch 70 is pushed downwards, the presser bar 74 is forced by the base block 73 to press the gas lever 52 of the gas lighter 50 causing the gas lighter 50 to release fuel gas. When the neck 72 passes through the gap between the inward projections 81, it become retained in the lower limit position below the inward projections 81, and therefore the gas lighter 50 continuously releases fuel gas permitting it to be guided to the flame nozzle 40 through the presser tube 42 and the gas tube 41. When the gas lighter 50 continuously releases fuel gas, the cylindrical control knob 60 is pushed forwards to press the ignition push button 32 causing the electronic ignition device 30 to catch fire in the flame nozzle 40 to burn released fuel gas. As the cylindrical control knob 60 is released from the hand, it is immediately pushed back to its former position by the curved tail 270 of the locating plate spring 27. When the slide switch 70 is pushed upwards, the presser bar 74 is released from the gas lever 52, and therefore fuel gas is stopped.

What is claimed is:

1. A handy gas torch comprising:

a gas lighter container, a gas lighter received in said gas lighter container, said gas lighter including a gas lever to control the release of fuel gas, a top case covering an upper end of said gas lighter, said top case defining a horizontal chamber, a top cover shell covering a top of said top case, a flame nozzle and a cylindrical ignition control knob retained between said top case and said top cover shell, an ignition device controlled by said ignition control knob and received in said horizontal chamber, a slide switch mounted on said top case at one side and moved between an upper limit position and a lower limit position at two opposing ends of a vertical sliding way, and a presser bar driven by said slide switch to press and release the gas lever of said gas lighter, such that a user activates the torch by moving said slide switch to said lower limit position, thereby moving said gas lever and causing fuel gas to flow to said flame nozzle, said fuel gas being ignited by the user moving said ignition control knob from an off position to an ignition position, thereby activating said ignition-device and generating a flame in said flame nozzle.

2. The handy gas torch of claim 1 wherein:

said torch includes means to hold said sliding switch in said lower limit position to allow the continuous flow of fuel gas.

3. The handy gas torch of claim 1 wherein:

said top case further comprises means to urge said ignition control knob back to said off position after the flame has been ignited.

4. The handy gas torch of claim 1 wherein:

said top case has a semi-circular opening and said top cover shell has a corresponding semi-circular opening, the two semi-circular openings forming a circular mounting hole to receive said ignition control knob.

* * * * *